US006118221A

United States Patent [19]

Kumasaka et al.

[11] Patent Number: 6,118,221

[45] Date of Patent: Sep. 12, 2000

[54] COLD-CATHODE TUBE LIGHTING CIRCUIT WITH PROTECTION CIRCUIT FOR PIEZOELECTRIC TRANSFORMER

[75] Inventors: Katsunori Kumasaka, Soma; Hiroyuki Sato, Sendai, both of Japan

[73] Assignee: Tokin Corporation, Miyagi, Japan

[21] Appl. No.: 09/173,306

[22] Filed: Oct. 15, 1998

[30] Foreign Application Priority Data

Oct. 16, 1997 [JP] Japan ..... 9-283364
Oct. 24, 1997 [JP] Japan ..... 9-292639

[51] Int. Cl.[7] ..... H05B 37/02

[52] U.S. Cl. ..... 315/208 PZ; 315/307; 315/224; 310/316

[58] Field of Search ..... 315/307, 224, 315/209 PZ, 127, 291; 310/316

[56] References Cited

U.S. PATENT DOCUMENTS

| | | | |
|---|---|---|---|
| 5,731,652 | 3/1998 | Shimada | 310/316 |
| 5,739,622 | 4/1998 | Zaitsu | 310/316 |
| 5,739,679 | 4/1998 | Takehara et al. | 323/299 |
| 5,796,213 | 8/1998 | Kawasaki et al. | 315/209 R |
| 5,886,514 | 3/1999 | Iguchi et al. | 323/299 |
| 5,894,184 | 4/1999 | Furuhashi et al. | 310/316 |
| 5,939,840 | 8/1999 | Nakagawa | 315/307 |

OTHER PUBLICATIONS

Patent Abstracts of Japan, vol. 096, No. 006, Jun. 28, 1996, JP 08033350 (Tamura Seisakusho Co. Ltd.), Feb. 2, 1996.
WO 9854934, Dec. 3, 1998, (Nihon Cement Kabushiki Kaisha).
EP 0 338 109 A, Oct. 25, 1989, (Zumtobel AG).

*Primary Examiner*—Don Wong
*Assistant Examiner*—Tuyet T. Vo
*Attorney, Agent, or Firm*—Hopgood, Calimafde, Kalil & Judlowe

[57] ABSTRACT

To provide a cold-cathode tube lighting circuit which quickly and smoothly carries out lighting of a cold-cathode tube and prevents damage of a piezoelectric transformer as an inverter transform in the lighting circuit, the lighting circuit is provided with a protection circuit for detecting a primary current of the piezoelectric transformer. The protection circuit stops operation of an oscillator for driving the piezoelectric transformer when the primary current is excessive. The protection circuit may be provided to detect excess of a secondary voltage of the piezoelectric transformer. When the cold-cathode tube is used as a backlight for a liquid crystal display driven by the use of a scanning frequency, a dimmer circuit is used for producing a dimmer signal with a dimmer frequency and a controlled duty ratio given by a manual selector for controlling start and stop of the oscillator according to a desired brightness of the backlight. The dimmer frequency is obtained from frequency division of the scanning frequency. The controlled duty ratio is also modified corresponding to the divided frequency.

10 Claims, 5 Drawing Sheets

COLD-CATHODE TUBE LIGHTING CIRCUIT WITH PROTECTION CIRCUIT FOR PIEZOELECTRIC TRANSFORMER

BACKGROUND OF THE INVENTION

The present invention relates to an AC power supply for lighting a cold-cathode tube and, in particular, to a cold-cathode tube lighting circuit having an inverter using a piezoelectric transformer as an inverter transformer.

As is well known in the prior art, an inverter comprises a transformer and a switching circuit for switching a DC input for driving the transformer at a controlled switching frequency. Thus, a DC/AC inverted power is taken out from the transformer. The transformer is called an inverter transformer.

A cold-cathode tube is used as a backlight for a liquid crystal display (LCD) used in a personal computer, a word processor or other electronic devices, especially, of a notebook type.

In order to meet the demand for small-sized and light-weight devices, a piezoelectric transformer has become used as the inverter transformer in the cold-cathode tube lighting circuit.

However, there has been a problem due to characteristics of the cold-cathode tube that the cold-cathode tube is difficult to light at a start when the inverter is powered on. This problem is notable at a relatively low ambient temperature where the current hardly flows through the cold-cathode tube. When the cold-cathode tube does not light, the piezoelectric transformer is kept open at its output so that the piezoelectric transformer is damaged in the worst case.

On the other hand, the known cold-cathode tube lighting circuit often has a light control circuit or a dimmer circuit. The dimmer circuit controls the switching operation in the inverter so that the switching operation is intermittently stopped at a dimmer frequency. In detail, the dimmer circuit generates a pulse signal as a dimmer signal having the dimmer frequency of a relatively high but sufficiently lower than the switching frequency. A duty ratio of the dimmer pulse signal is controlled to a desired value selected by a manual selector. Thus, the switching operation is performed and stopped every ON duration and every OFF duration, respectively, of the dimmer pulse signal. The piezoelectric transformer intermittently supplies its AC output power to the cold-cathode tube. The cold-cathode tube repeatedly flushes every ON duration at the dimmer frequency. Therefore, it is possible to adjust the brightness of the cold-cathode tube by selecting a desired duty ratio by the manual selector.

In the liquid crystal display, displaying is made through scanning using a driving signal. If a frequency of the scanning in the liquid crystal display and the dimmer frequency do not have a constant relationship, interference fringes appear on a screen of the liquid crystal display by light interference caused due to a difference between both frequencies.

For example in a monitor of a liquid crystal display, the scanning frequency is typically 1 kHz to 100 kHz while the dimmer frequency is 100 Hz to 10 kHz. However, there has been inconvenience that a higher-order frequency component of the dimmer signal is nearly equal to but slightly different from the scanning frequency to cause the interference fringes on the liquid crystal display.

The problem could be avoided by changing the dimmer frequency in the dimmer circuit depending on the scanning frequency of the liquid crystal display.

However, since there are a number of types of the liquid crystal display having various scanning frequencies, it is difficult to adjust the dimmer frequency in the dimmer circuit in the cold-cathode tube lighting circuit for any type of the liquid crystal display, resulting in increase of the cost.

Another known approach for preventing appearance of the interference fringes is to insert a transparent conductive sheet such as ITO ($In_2O_3$:Sn) film between a panel of the liquid crystal and the cold-cathode tube.

However, the transparent conductive sheet need to increase in size according to large size of the liquid crystal panel. This also results in increase of the cost.

SUMMARY OF THE INVENTION

Therefore, it is an object of the present invention to provide a cold-cathode tube lighting circuit having an inverter using a piezoelectric transformer as an inverter transformer, which is excellent in the lighting performance upon a start of the inverter powered on, even at a low ambient temperature.

It is another object to provide such a cold-cathode tube lighting circuit which can protect the piezoelectric inverter transformer from a dangerous condition where it is kept open at its output thereby to be damaged.

It is another object to provide a cold-cathode tube lighting circuit having an inverter using a piezoelectric transformer as an inverter transformer and a light control circuit which can control a brightness of the cold-cathode tube as a backlight of a liquid crystal display without making any interference fringes on the display.

According to the present invention, there is provided a cold-cathode tube lighting circuit for lighting a cold-cathode tube which comprises a piezoelectric transformer having a given resonance frequency for producing an AC output for lighting the cold-cathode tube; a voltage-controlled oscillator for producing an oscillating signal with a controlled oscillating frequency near the resonance frequency; a driving circuit responsive to the oscillating signal for driving the piezoelectric transformer; a cold-cathode tube current detection circuit for detecting a current flowing through the cold-cathode tube connected to the piezoelectric transformer to produce a detection signal dependent on the current detected, the voltage controlled oscillator being controlled in the oscillating frequency by the detection signal; and a protection circuit for protecting the piezoelectric transformer in response to a load impedance of said piezoelectric transformer.

Preferably, the cold-cathode tube lighting circuit further comprises a dimmer circuit for producing a dimmer signal with a dimmer frequency and a controlled duty ratio corresponding to a desired brightness of the cold-cathode tube. The voltage controlled oscillator is controlled by the dimmer signal to intermittently operate every ON duration of the dimmer signal.

The cold-cathode tube may be a backlight for a liquid crystal display by scanning by a driving signal under a scanning frequency. Preferably, the cold-cathode tube lighting circuit further comprises a frequency divider to be connected to the liquid crystal display for frequency-dividing the scanning frequency to produce a divided signal with a divided frequency. The dimmer circuit is responsive to the divided signal and produces the dimmer signal having the divided frequency as the dimmer frequency.

Preferably, the cold-cathode tube lighting circuit further comprises a frequency voltage converter connected to the frequency divider and responsive to the divided signal for producing a voltage signal corresponding to the divided frequency. The dimmer circuit is responsive to the voltage signal and modifies the controlled duty ratio so as to maintain the desired brightness of the cold-cathode tube under a change of the scanning frequency.

DESCRIPTION OF PREFERRED EMBODIMENTS

Figure 1:
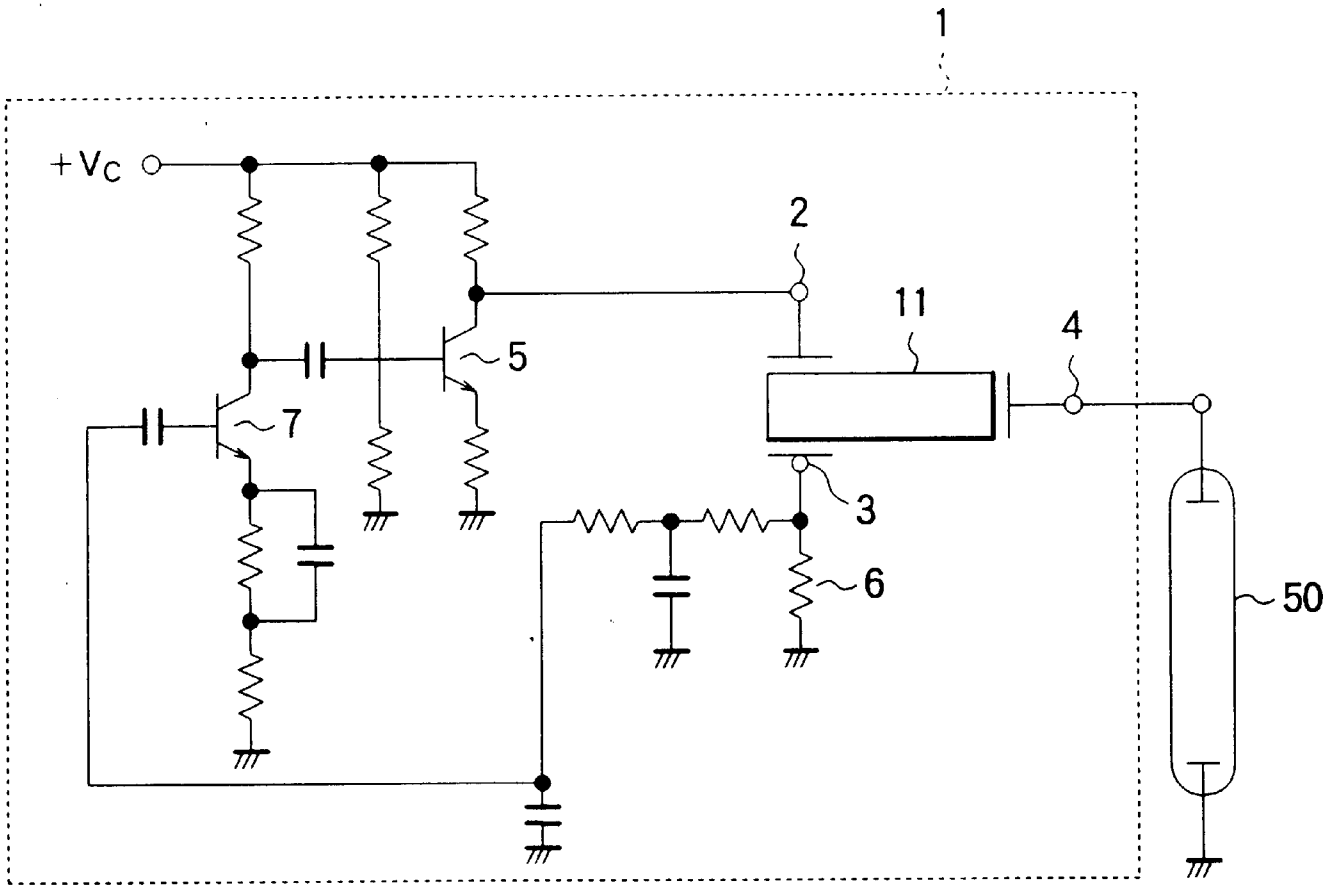
FIG. 1 PRIOR ART
FIG. 1 is a circuit diagram showing a cold-cathode tube lighting circuit comprising an inverter using a piezoelectric transformer known in the prior art.

Prior to description of preferred embodiments, description will be made as regards two types of a conventional cold-cathode tube lighting circuit with reference to the drawing.

Referring to FIG. 1, an inverter 1 used in a conventional cold-cathode tube lighting circuit uses a piezoelectric transformer 11. When a DC voltage +Vc is applied to an input port of the inverter 1, a switching transistor or driving transistor 5 turns on so that an output voltage of the driving transistor 5 is applied to a primary side of the piezoelectric transformer 11 through input terminals 2 and 3. As a result, a primary current flows through a voltage divider resistor 6 for detecting an output.

A voltage across the voltage divider resistor 6 caused by the primary current is amplified by an amplifying transistor 7, and then controls switching of the driving transistor 5. In this manner, the switching frequency of the driving transistor 5 follows a resonance frequency of the piezoelectric transformer 11 to maintain the self-oscillation so that a cold-cathode tube 50 connected to an output terminal 4 of the piezoelectric transformer 11 can be lighted.

The cold-cathode tube lighting circuit has a problem at the start or power-on condition as described in the preamble.

Figure 2:
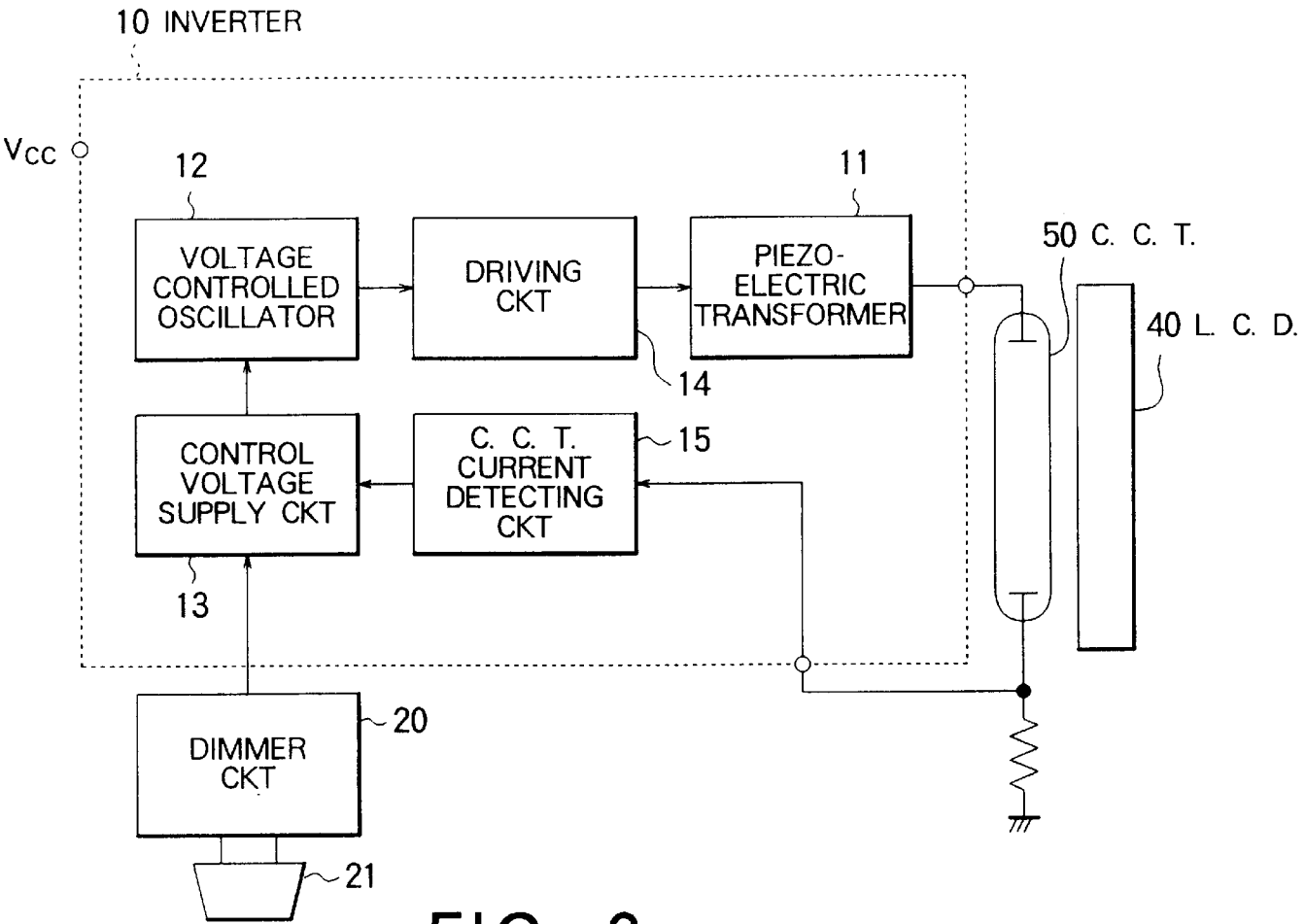
FIG. 2 PRIOR ART
FIG. 2 is a block diagram showing a cold-cathode tube lighting circuit comprising an inverter using a piezoelectric transformer known in the prior art.

Referring to FIG. 2, there is shown another type of the known lighting circuit which is used for lighting a cold-cathode tube (C.C.T.) 50 as a backlight of a liquid crystal display 40. The lighting circuit has an inverter 10 which comprises a piezoelectric transformer 11, a voltage controlled oscillator (V.C.O.) 12, a control voltage supply circuit 13, a driving circuit 14, and a cold-cathode tube (C.C.T.) current detecting circuit 15. The lighting circuit further has a dimmer circuit 20 with a manual selector or adjuster 21 for producing a dimmer signal for burst controlling the luminescence of the cold-cathode tube 50 so as to control the brightness thereof.

After the power VCC is turned on, the voltage controlled oscillator 12 produces an oscillating signal with an oscillating frequency determined by a control voltage given from the control voltage supply circuit 13. The oscillating signal is supplied to the driving circuit 14 and switches a switching transistor therein to apply a switched power as a primary power to the primary side of the piezoelectric transformer 11. Therefore, the oscillating frequency is a switching frequency. A secondary output of the piezoelectric transformer 11 is applied to the cold-cathode tube 50 for lighting it. Then, a low current flows through the cold-cathode tube 50. The current is detected as a detected voltage signal at the cold-cathode tube current detecting circuit 15. In detail, the cold-cathode tube current detecting circuit 15 comprises a resistor connected to the cold-cathode tube 50, and a rectifying and smoothing circuit connected to the resistor. An AC voltage is generated across the resistor due to the cold-cathode tube current flowing therethrough and is rectified and smoothened at the rectifying and smoothing circuit. Thus, the detected voltage signal is obtained from the rectifying and smoothing circuit. The detected voltage signal is applied to the control voltage supply circuit 13. The voltage supply circuit 13 adjusts a level of the control voltage signal in response to the detected voltage signal. Thus, the current flowing through the cold-cathode tube 50 is fed back to the voltage controlled oscillator 12 and controls the oscillation frequency thereof to follow the resonance frequency of the piezoelectric transformer 11. As a result, the secondary output voltage of the piezoelectric transformer 11 is increased to cause the cold-cathode tube 50 to start discharging. Accordingly, the current flowing through the cold-cathode tube 50 is abruptly increased, and the oscillation frequency of the voltage controlled oscillator 12 is controlled and stabilized at the resonance frequency of the piezoelectric transformer 11. Thereby, the luminescence of the cold-cathode tube 50 is also stabilized.

The dimmer circuit 20 is for adjusting the brightness of the cold-cathode tube 50. The dimmer circuit 20 outputs as a dimmer signal a pulse signal with a controlled duty ratio. The duty ratio is selected by adjusting the manual selector or switch 21. In response to the dimmer signal, the control voltage supply circuit 13 stops supplying the control voltage signal to the voltage controlled oscillator 12 during every OFF duration of the dimmer signal, so as to control an oscillation period (that is, start/stop) of the voltage controlled oscillator 12. In detail, the control voltage supply circuit 13 has an AND gate which has two inputs to which the dimmer signal and the control voltage signal are applied, respectively, and an output connected to the voltage controlled oscillator 12. Therefore, the control voltage signal is intermittently supplied to the voltage controlled oscillator 12 under control of the dimmer signal. Thus, the voltage controlled oscillator 12 is operated during an ON period of the dimmer signal, while it is stopped during an OFF period of the dimmer signal. In response thereto, the luminescence of the cold-cathode tube 50 becomes ON and OFF. As a result, since the time-averaged luminous intensity of the cold-cathode tube 50 over a time far longer than a period of the dimmer signal changes depending on the duty ratio, the brightness is adjusted.

For the adjustment of the duty ratio, the known pulse width modulation technique is used. Specifically, the dimmer signal is produced by waveform-converting a triangular wave of a given dimmer frequency into a square wave by the use of a reference level. The duty ratio of the rectangular waveform signal or the dimmer signal is changed by adjusting the reference level through the operation of the manual selector 21.

The cold-cathode tube lighting circuit has problems as described in the preamble.

Now, referring to FIG. 3, a cold-cathode tube lighting circuit will be described. The lighting circuit shown in the figure is similar to the circuit shown in FIG. 2 except provision of a protection circuit 30 for protecting the piezoelectric transformer 11 from the change in load impedance. The similar portions are denoted by the same reference numerals and are not described for the purpose of simplification of the description.

As described in the preamble, when the cold-cathode tube 50 is not lighted due to its darkening effect or standing at low temperatures, the secondary side of the piezoelectric transformer 11 is kept open so that the piezoelectric transformer 11 becomes supplied with an excessive power and is damaged thereby.

Therefore, in order to protect the piezoelectric transformer 11, the protection circuit 30 detects a current flowing at the primary side of the piezoelectric transformer 11. When the excessive current is detected, the protection circuit 30 outputs a detection signal or a stop signal. In response to the detection signal, the voltage controlled oscillator 12 temporarily stops its output. Specifically, the protection circuit 30 comprises a resistor connected between an output of the driving circuit 14 and the ground, a voltage comparator having an input connected to the output of the driving circuit 14 and another input connected to a reference voltage source. The voltage comparator produces the detection signal when a voltage across the resistor is excessive the reference voltage. The detection voltage is supplied to the voltage controlled oscillator 12 as the stop signal. For example, the voltage controlled oscillator 12 has a switch in its output circuit which is, in turn, switched off by the stop signal. As a result, the driving voltage is not applied to the primary side of the piezoelectric transformer 11. Then, the current does not flow at the primary side of the piezoelectric transformer 11, and therefore, the protection circuit 30 produces no detection signal. Thus, the voltage controlled oscillator 12 is again operated to output an oscillation signal, and a driving power is again supplied to the primary-side of the piezoelectric transformer 11.

The operations of start, stop and restart of the voltage controlled oscillator 12 under control by the protection circuit 30 are repeated until the cold-cathode tube 50 is lighted so that the cold-cathode tube current is detected at the cold-cathode tube current detecting circuit 15. During the repeat, a burst AC voltage is intermittently applied to the piezoelectric transformer 11. It is preferable that a period of the burst is not greater than 20 ms in consideration of ensuring the lighting performance and protecting the piezoelectric transformer 11.

On the other hand, if the secondary side of the piezoelectric transformer 11 is held open due to damage of the cold-cathode tube 50 etc., the cold-cathode tube current does not flow even by repeating the foregoing operations. Accordingly, it is necessary that the foregoing repetitive operation is stopped after the lapse of several seconds. To this end, the timer circuit may be provided with, for example, a timer circuit 31 having a predetermined timer operating time of, for example, several seconds. The timer circuit 31 is released when the cold-cathode tube current is detected at the cold-cathode tube current detecting circuit 15 before the timer operating time is expired. On the other hand, unless the cold-cathode tube current is detected during the timer operation, the timer circuit 31 produces a timer signal when the timer operating time has expired. The timer signal is supplied as another stop signal to the voltage controlled oscillator 12. Thus, the voltage controlled oscillator 12 stops delivering its output to the driving circuit 14.

Figure 3:
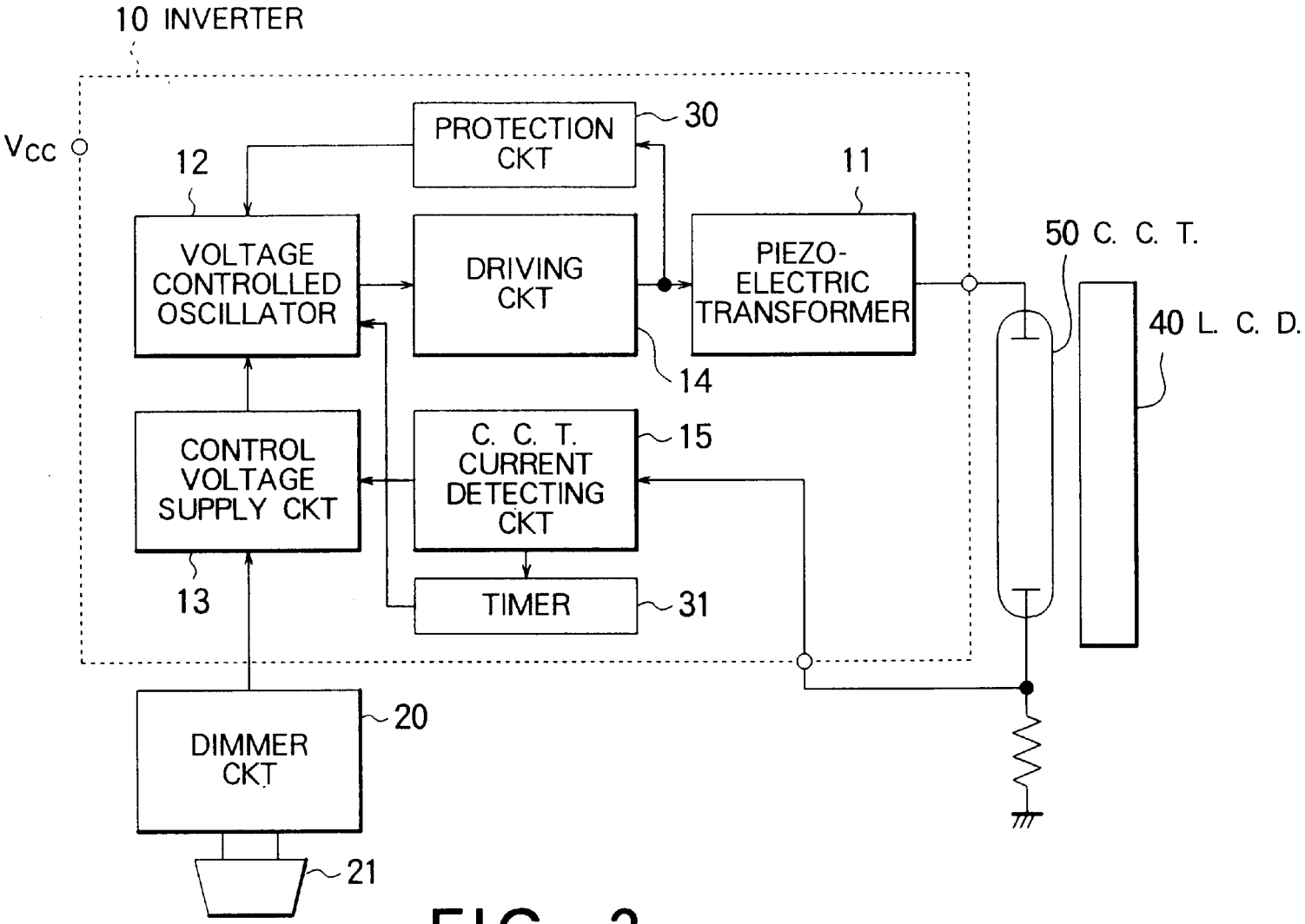
FIG. 3 is a block diagram showing a cold-cathode tube lighting circuit having a protection circuit according to an embodiment of the present invention.
Figure 4:
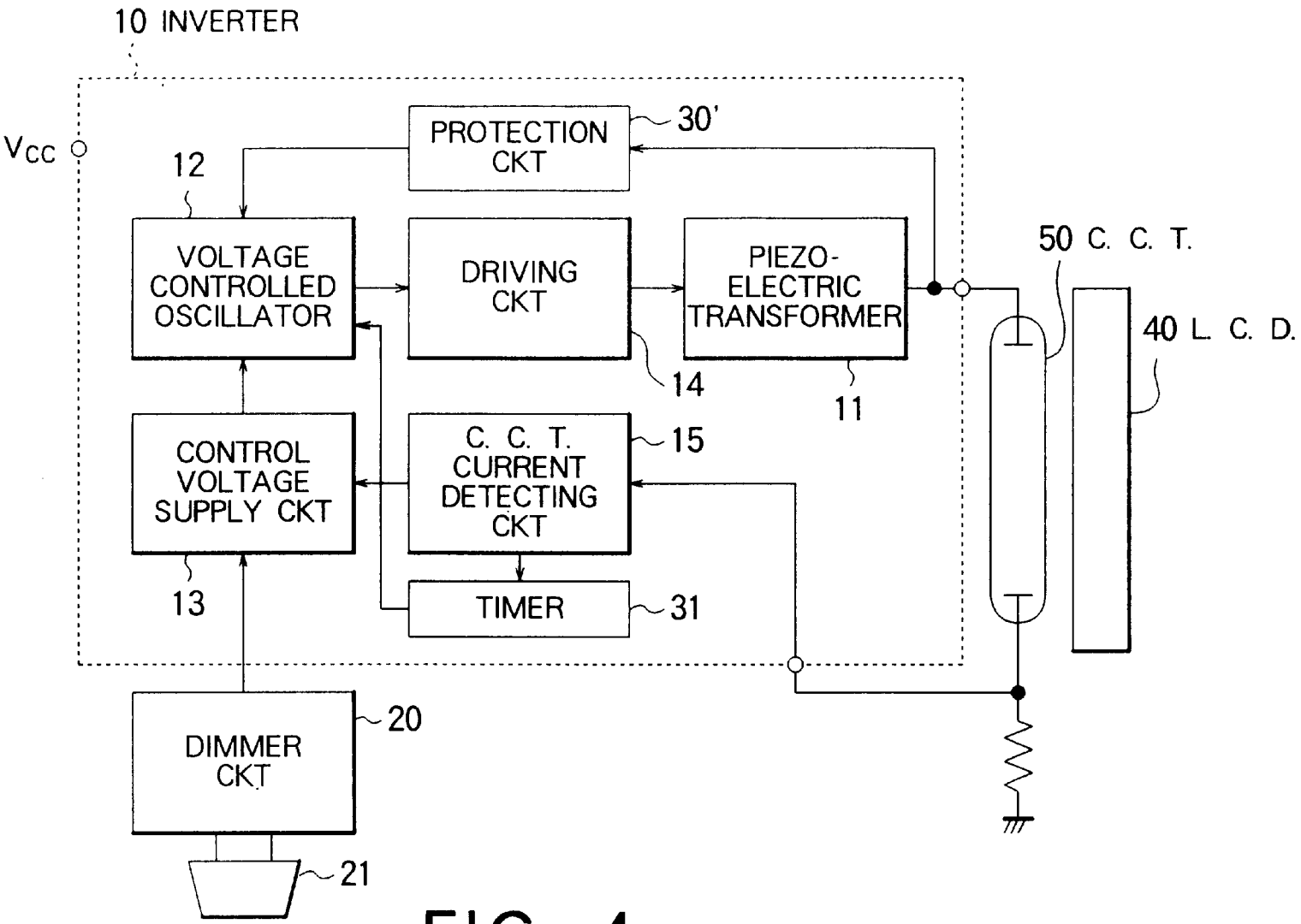
FIG. 4 is a block diagram showing a cold-cathode tube lighting circuit having another protection circuit according to another embodiment of the present invention.
Figure 5:
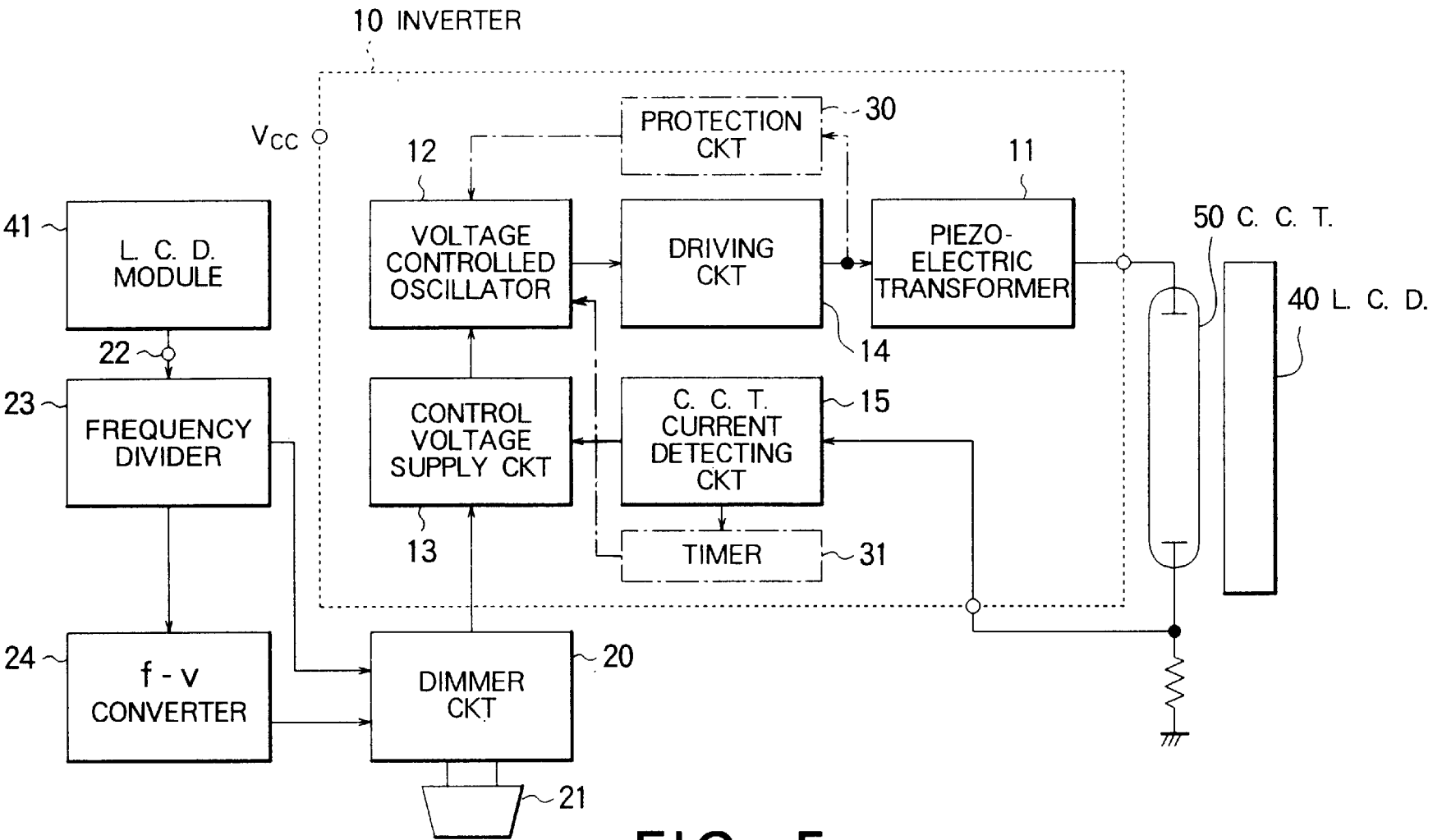
FIG. 5 is a block diagram showing a cold-cathode tube lighting circuit having a light control circuit according to another embodiment of the present invention.

Referring to FIG. 4, the lighting circuit shown therein is in a modification of the circuit of FIG. 3. In detail, the protection circuit detects not the primary current of the piezoelectric transformer 11 but the secondary voltage of the piezoelectric transformer 11, as shown at 30'. When the protection circuit 30' detects an excess voltage over a predetermined voltage on the secondary side of the piezoelectric transformer 11, the protection circuit 30' produces the detection signal. The protection circuit 30' comprises a voltage comparator which has two inputs connected to a secondary output of the piezoelectric transformer 11 and a reference voltage source, respectively, and an output. When the secondary output voltage of the piezoelectric transformer 11 is excessive the reference voltage, the detection signal is produced on the output. The detection signal is supplied as the stop signal to the voltage controlled oscillator 12, and therefore, the voltage controlled oscillator 12 stops oscillation. Referring to FIG. 5, the cold-cathode tube lighting circuit shown therein is similar to the lighting circuit of FIG. 2, but provision of control of the dimmer circuit 20. The similar portions are denoted by the same reference numerals and description thereof is omitted for the purpose of simplification.

The cold-cathode tube lighting circuit is provided with a connection terminal 22 to a liquid crystal panel module 41 of the liquid crystal display 40 and receives a driving signal of the liquid crystal display from the liquid crystal panel module 41 connected thereto. The cold-cathode tube lighting circuit has a frequency divider circuit 23 which is applied with the driving signal of the liquid crystal display 40 from the module 41 and divides its scanning frequency to produce a signal having a divided frequency (the signal is hereinafter referred to as a "divided signal"). The dividing ratio can be properly determined depending on necessity. The divided signal is supplied to the dimmer circuit 20.

The dimmer circuit 20 carries out a waveform conversion (or waveform shaping) of the divided signal into a triangular wave signal of the same divided frequency and further carries out another waveform conversion from the triangular waveform signal into a square wave signal. Before the waveform conversion into the square wave signal, the reference level of the triangular wave is adjusted using a duty ratio set by the manual selector 21. Accordingly, the converted square wave signal has the duty ratio corresponding to a desired brightness. In this manner, the dimmer signal is supplied to the control voltage supply circuit 13 to control the brightness of the cold-cathode tube 50.

Since the frequency of the dimmer signal is synchronous with the driving scanning frequency of the liquid crystal display, the interference fringes are prevented from appearing on the display screen. Further, the frequency of the dimmer signal is synchronized with the scanning frequency of the liquid crystal display only by connecting the liquid crystal panel module 41 to the cold-cathode tube lighting circuit. Therefore, it is advantageous that no setting change or adjustment of the frequency of the dimmer signal is necessary relative to a liquid crystal display having a different scanning frequency.

It will be noted that, when the dimmer frequency changes under a constant duty ratio, the sum of ON times for a unit time does not become constant. Accordingly, the time-averaged luminous intensity, that is, the brightness, of the cold-cathode tube 50 does not become constant. Therefore, there is an inconvenience that even if the manual selector 21 is adjusted to a same duty ratio according to the same brightness, the brightness of the cold-cathode tube 50 is not controlled to the same brightness in case of a liquid crystal display having a different scanning frequency.

For solving such inconvenience, the cold-cathode tube lighting circuit further includes a frequency-voltage conversion circuit (f-v converter) 24. The f-v convertor 24 is applied with the divided signal from the frequency divider circuit 23 and converts it into a voltage signal corresponding to the frequency thereof. This voltage signal is supplied to the dimmer circuit 20.

In response to the voltage signal, the dimmer circuit 20 modifies the reference level selected by the manual selector 21 so that the duty ratio of the dimmer signal is modified in dependence on the dimmer frequency for the same brightness selected by the manual selector 21. Therefore, with no relation to the scanning frequency of the liquid crystal display 40, the actual brightness of the cold-cathode tube becomes constant for the same operation of the manual selector 21. The cold-cathode lighting circuit of FIG. 5 can also provide with the protection circuit 30 and the timer 31 described in connection with FIG. 3, as shown by imaginary lines and blocks with same reference numerals in FIG. 5. The protection circuit 30' shown in FIG. 4 can also be used in place of the protection circuit 30.

What is claimed is:

1. A cold-cathode tube lighting circuit for lighting a cold-cathode tube which comprises:

a piezoelectric transformer having a given resonance frequency for producing an AC output for lighting the cold-cathode tube;

a voltage controlled oscillator for producing an oscillating signal with a controlled oscillating frequency near said resonance frequency;

a driving circuit responsive to said oscillating signal for driving said piezoelectric transformer;

a cold-cathode tube current detection circuit for detecting a current flowing through said cold-cathode tube connected to said piezoelectric transformer to produce a detection signal dependent on the current detected, said voltage controlled oscillator being controlled in the oscillating frequency by the detection signal;

a protection circuit for protecting said piezoelectric transformer in response to a load impedance of said piezoelectric transformer; and a timer circuit coupled with said cold-cathode tube current detecting circuit and said voltage controlled oscillator for limiting repeated restart of said voltage controlled oscillator when the AC output side of said piezoelectric transformer is open, said timer circuit being started upon start of said cold-cathode tube lighting circuit, then operating for a given time for stopping said voltage controlled oscillator after a lapse of said given time, said timer circuit being released when said cold-cathode tube current detection circuit produces said detection signal within the given time period of said timer circuit after start.

2. The cold-cathode tube lighting circuit as claimed in claim 1, wherein said protection circuit is a circuit which detects an input current of said piezoelectric transformer to produce a stop signal for stopping said voltage controlled oscillator only when said input current is excessive over a predetermined level, so that said lighting power is intermittently applied to the cold-cathode tube upon start of lighting the cold-cathode tube.

3. The cold-cathode tube lighting circuit as claimed in claim 1, wherein said protection circuit is a circuit which detects a secondary voltage of said piezoelectric transformer to produce a stop signal for stopping operation of said voltage controlled oscillator only when said secondary output is excessive over a predetermined level, so that said lighting power is intermittently applied to the cold-cathode tube upon start of lighting the cold-cathode tube.

4. The cold-cathode tube lighting circuit as claimed in claim 1, which further comprises a dimmer circuit for producing a dimmer signal with a dimmer frequency and a controlled duty ratio corresponding to a desired brightness of the cold-cathode tube, said voltage controlled oscillator being controlled by said dimmer signal to intermittently operate every ON duration of said dimmer signal.

5. The cold-cathode tube lighting circuit as claimed in claim 4, said cold-cathode tube being a backlight for a liquid crystal display by scanning by a driving signal under a scanning frequency, which further comprises a frequency divider to be connected to said liquid crystal display for frequency-dividing said scanning frequency to produce a divided signal with a divided frequency, said dimmer circuit responsive to said divided signal to produce said dimmer signal having the divided frequency as said dimmer frequency.

6. The cold-cathode tube lighting circuit as claimed in claim 5, which further comprises a frequency voltage converter connected to said frequency divider and responsive to said divided signal for producing a voltage signal corresponding to said divided frequency, said dimmer circuit responsive to said voltage signal for modifying said controlled duty ratio so as to maintain the desired brightness of said cold-cathode tube under a change of said scanning frequency.

7. A liquid crystal display back light lighting circuit comprising a voltage producing circuit for producing an AC voltage for lighting a back light for a liquid crystal display driven by a liquid crystal driving signal of a liquid crystal scanning frequency, and a dimmer circuit for producing a dimmer signal having a dimmer frequency with a duty ratio corresponding to desired brightness of the back light and ON/OFF controlling the AC voltage of said voltage producing circuit, wherein said frequency of said dimmer signal is synchronized with said liquid crystal scanning frequency, and wherein said voltage producing circuit comprises a piezoelectric transformer having a given resonance frequency for producing a lighting voltage for the cold-cathode tube, a voltage controlled oscillator for oscillating at a frequency near said resonance frequency, a driving circuit for driving said piezoelectric transformer in response to an output of said voltage controlled oscillator, a back light current detection circuit for detecting current flowing through said cold-cathode tube connected to said piezoelectric transformer, said voltage controlled oscillator being controlled to provide an oscillation frequency by a detection signal from said back light current detection circuit, and said voltage controlled oscillator being also controlled to start and stop its operation by the dimmer signal from said dimmer circuit, and a protection circuit for protecting said piezoelectric transformer in response to a load impedance of said piezoelectric transformer.

8. The liquid crystal display back light lighting circuit as claimed in claim 7, which further comprises a timer circuit coupled with said cold-cathode tube current detecting circuit and said voltage controlled oscillator for limiting repeated restart of said voltage controlled oscillator when the AC output side of said piezoelectric transformer is open, said timer circuit being started upon start of said cold-cathode tube lighting circuit, then operating for a given time for stopping said voltage controlled oscillator after a lapse of said given time, said timer circuit being released when said cold-cathode tube current detection circuit produces said detection signal within the given time period of said timer circuit after start.

9. The liquid crystal display back light lighting circuit as claimed in claim 7, further comprising a divider which is applied with said liquid crystal driving signal and divides the liquid crystal scanning frequency thereof at a given dividing ratio to produce a divided signal with a divided frequency, said dimmer circuit producing said dimmer signal having said divided frequency as said dimmer frequency and having said duty ratio.

10. The liquid crystal display back light lighting circuit as claimed in claim 9, which further comprise a frequency-voltage converter for converting the divided signal from said divider into a voltage signal corresponding to the frequency thereof, said dimmer circuit responsive to said voltage signal for controlling an adjusting degree of the duty ratio of said dimmer signal based on said voltage signal so as to render constant a brightness adjustment irrespective of the frequency of said dimmer signal.

* * * * *